US006260626B1

(12) United States Patent
Rivas

(10) Patent No.: US 6,260,626 B1
(45) Date of Patent: Jul. 17, 2001

(54) METHOD AND APPARATUS FOR COMPLETING AN OIL AND GAS WELL

(75) Inventor: Olegario S. Rivas, Bartlesville, OK (US)

(73) Assignee: Camco International, Inc., Houston, TX (US)

( * ) Notice: Subject to any disclaimer, the term of this patent is extended or adjusted under 35 U.S.C. 154(b) by 0 days.

(21) Appl. No.: 09/256,070

(22) Filed: Feb. 24, 1999

(51) Int. Cl.[7] ..... E21B 43/38
(52) U.S. Cl. ..... 166/369; 166/105.5; 166/265
(58) Field of Search ..... 166/105.5, 105, 166/106, 68, 265, 369, 66.4, 242.6

(56) References Cited

U.S. PATENT DOCUMENTS

| | | | | |
|---|---|---|---|---|
| 2,242,166 | | 5/1941 | Bennett | 103/1 |
| 3,841,400 | | 10/1974 | Callihan et al. | 166/120 |
| 4,502,536 | | 3/1985 | Setterberg, Jr. | 166/105.5 |
| 4,589,482 | | 5/1986 | Bayh, III | 166/105.5 |
| 4,624,310 | | 11/1986 | Echols et al. | 166/106 |
| 4,632,184 | | 12/1986 | Renfroe, Jr. et al. | 166/105.5 |
| 4,898,244 | | 2/1990 | Schneider et al. | 166/297 |
| 4,913,239 | * | 4/1990 | Bayh, III | 166/385 |
| 5,154,588 | * | 10/1992 | Freet et al. | 417/423.3 |
| 5,309,998 | | 5/1994 | Rivas et al. | 166/265 |
| 5,343,945 | | 9/1994 | Weingarten et al. | 166/105.5 |
| 5,657,821 | | 8/1997 | Beauquin et al. | 166/68 |
| 6,082,452 | * | 7/2000 | Shaw et al. | 166/105.5 |

* cited by examiner

*Primary Examiner*—David Bagnell
*Assistant Examiner*—Zakiya Walker
(74) *Attorney, Agent, or Firm*—Fletcher, Yoder & Van Someren

(57) ABSTRACT

A technique is provided for supplying electrical power to a submersible pumping system in a well completion. The pumping system includes a submersible electric motor, a pump driven by the motor and a separator for separating liquid and gas phase components of the wellbore fluids. The gas phase components are produced through a first passageway in an isolating packer, with liquid phase components being produced through a separate passageway through the packer. A transition assembly, including a connector adapter is provided in either the liquid or gas flow path, and either on the lower or upper side of the packer. The transition assembly incorporates a connector for securing upper and lower cable portions to one another. The lower cable portion extends from the connector to the electric motor, while the upper cable assembly extends from the connector to the earth's surface.

27 Claims, 3 Drawing Sheets

METHOD AND APPARATUS FOR COMPLETING AN OIL AND GAS WELL

BACKGROUND OF THE INVENTION

1. Field of the Invention

The present invention relates generally to the field of completion systems for oil and gas production wells. More particularly, the invention relates to a technique for completing a production well through the use of a submersible pumping system to which power is routed through the equipment in a novel manner.

2. Description of the Related Art

A wide variety of systems are known and have been proposed for producing fluids of economic interest from subterranean geological formations. In formations providing sufficient pressure to force the fluids to the earth's surface, the fluids may be collected and processed without the use of artificial pumping systems. Where, however, well pressures are insufficient to raise fluids to the collection point, artificial means are typically employed, such as submersible pumping systems.

The particular configurations of submersible pumping systems may vary widely depending upon the well conditions, the geological formations present, and the desired completion approach. In general however, such systems typically include an electric motor driven by power supplied from the earth's surface. The motor is coupled to a pump which draws wellbore fluids from a production horizon and imparts sufficient head to force the fluids to the collection point. Such systems may include additional components especially adapted for the particular wellbore fluids or mix of fluids, including gas/oil separators, oil/water separators, water injection pumps, and so forth.

Submersible pumping systems may be deployed in a number of different manners. Conventionally, such systems were deployed at the end of a high tensile strength cable assembly. Power conductors, bundled in a separate assembly or in a common assembly with the suspension cables, served to supply power to the submersible electric motor. Other, more recent, deployment schemes include arrangements in which the submersible pumping system is suspended from a conduit, such as a length of coiled tubing. In systems of this type, the power cable may be enclosed in the conduit, or may be external to the conduit, typically in an annular region between the wellbore casing and the conduit. The latter arrangement is often preferred due to the need to convey the production fluids, typically petroleum and entrained minerals, through the conduit to the earth's surface.

While both cable and coiled tubing deployed pumping systems of the type described above are generally adequate for many applications, they are not without drawbacks. For example, where a conduit is used to deploy the system, the annular region surrounding the conduit often provides a greater cross-sectional area for the flow of production fluids. However, in certain completions, more than one production fluid is displaced, such as petroleum in one conduit and natural gas in another conduit or in the annular area. Recently, systems have been proposed for transmitting gas in a conduit, such as coiled tubing, and oil in the larger annular area between the conduit and the wellbore casing. These systems are particularly attractive where environmental conditions permit direct contact between the production fluids and the wellbore casing, or where liners or other protective coatings may be employed within the casing. However, such systems often call for the placement of a pumping system below a packer used to separate the pump inlet zone of the well from the pump outlet or discharge zone. A difficulty in these systems arises in conveying electrical power through the packer to the lower zone in which the submersible electric motor is positioned.

There is a need, therefore, for an improved technique for conveying power and control signals to equipment below a packer in a well completion. There is a particular need for a completion which provides easily field-installable electrical connections which can be made in a sealed manner during initial installation of pumping systems and similar equipment.

SUMMARY OF THE INVENTION

The invention provides a novel technique for completing an oil and gas well designed to respond to these needs. The technique permits both liquid and solid phase components of wellbore fluids to be produced in separate conduits. For example, gas may be separated from oil produced in the well and conveyed to a collection point via a conduit such as coiled tubing. Oil from which the gas is separated may then be produced in an annular region of the well surrounding the gas production conduit. The submersible pumping system, or at least the driving motor, is positioned below a packer separating the production zone of the well from the discharge zone. A cable connector assembly permits electrical conductors to be installed for transmitting electrical power from the earth's surface to the submersed pumping system, with the cable being positioned in one of two flow paths defined through the packer. The cable connection arrangement may be positioned either above or below the packer, and the passage through which the cable extends will be defined by the resulting structure. The connector assembly may be field-installable, thereby providing a quick and straightforward electrical connection which can be easily made up and serviced.

BRIEF DESCRIPTION OF THE DRAWINGS

The foregoing and other advantages of the invention will become apparent upon reading the following detailed description and upon reference to the drawings in which.

DETAILED DESCRIPTION OF SPECIFIC EMBODIMENTS

Figure 1:
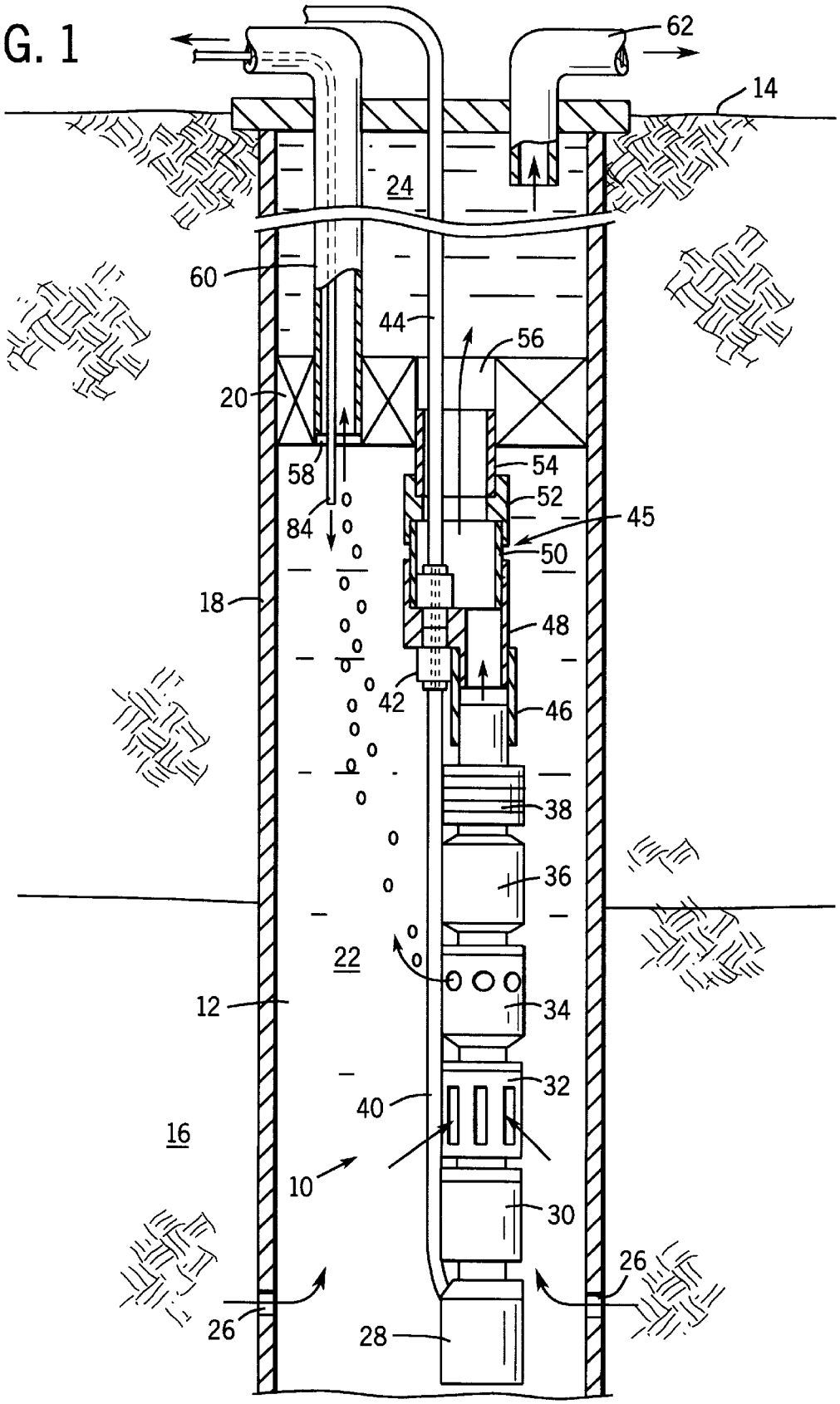
FIG. 1 is an elevational view of an exemplary pumping system positioned in an oil and gas well in a completion in accordance with the present technique.

Turing now to the drawings and referring first to FIG. 1, a completion system 10 is illustrated diagrammatically, deployed in a well 12 for the production of oil and gas. Well 12 extends from the earth's surface 14 through a series of subterranean zones or horizons, including a production formation 16. In general, production formation 16 will include geological formations bearing fluids of interest, such as crude oil, gas, paraffin, and so forth. Wellbore 14 is defined by an annular casing 18 which insures integrity of the wellbore.

It should be noted that, while in the illustrated embodiment and throughout the present description, reference is made to a completion in a wellbore which is generally vertically oriented, the present technique is not intended to be limited to this or any particular well configuration. Rather, the present technique may be adapted by those skilled in the art to wells including one or more production formations 16, as well as injection zones, gas producing horizons, and so forth. Moreover, the technique may be employed with completions in wells having inclined or horizontal sections.

In the embodiment shown in FIG. 1, completion 10 includes a packer 20 extending to the well casing 18. The packer segments the well into a lower region 22 and an upper region 24. Perforations 26 are formed adjacent to production formation 16 in lower region 22 to permit fluids to flow into the well from the production formation. Such fluids will collect in the well and are displaced by the completion as described more fully below.

The completion illustrated in FIG. 1 is particularly well suited to producing both liquid and gas phase components of wellbore fluids. As will be appreciated by those skilled in the art, such wells may produce both oil and gas in solution or in dispersions in varying ratios. To enhance the rate of production of both oil and gas, the gas phase components, or a substantial portion of the components, may be separated from the liquid phase components. The liquid phase components may then be forced upward in the well to a collection point, and the gas phase components may be similarly produced or stored. It should be borne in mind that while in the following description the gas phase components are produced to the earth's surface, in appropriate applications these components may be compressed and stored, reinjected into appropriate horizons, and so forth.

For producing the wellbore fluids, completion 10 includes a submersible pumping system driven by a submersible electric motor 28. Motor 28 may be any suitable type of motor, such as a polyphase induction motor, permanent magnet motor, or the like. Moreover, motor 28 may include an interior flooded region in which a high quality mineral oil is provided for cooling purposes. A motor protector 30 is coupled to motor 28 to prevent intrusion of wellbore fluids into the motor, and to otherwise protect the motor from high pressures and temperatures which may be present in the wellbore. Again, any suitable motor protector may be employed, such as motor protectors made by Reda Pump, of Bartlesville, Okla., and including fluid barriers such as expandable bladders, labyrinth seals, and so forth.

In the illustrated embodiment, elements of completion 10 are driven by motor 28 through the intermediary of motor protector 30. Accordingly, an inlet section 32 is secured to the motor protector and includes apertures through which wellbore fluids are drawn during operation. The wellbore fluids pass from inlet section 32 to a separator 34 where gaseous components are separated from liquid components of the fluids. In presently preferred embodiments, separator 34 may include both dynamic and static elements, such as hydrocyclone separator sections, centrifugal separator sections, and so forth. Gas phase components exit separator 34 and are transmitted from the well as described more fully below. Liquid phase components are transmitted from separator 34 to an inlet of a pump 36, also driven by a transmission shaft extending from motor 28 and through motor protector 30, inlet section 32, and separator 34. Pump 36 displaces the liquid phase components, which in practice may include some smaller proportion of gas-phase components, to a discharge section as indicated at reference numeral 38. From discharge section 38, the liquid phase components are transmitted through packer 20 upward and through upper region 24 of the well as described below.

It will be noted that the components of the pumping system in the completion, including the electrical motor, the motor protector, the separator and the pump, are situated in the lower portion 22 of well 12. Because this zone of the well is situated on a side of packer 20 opposite that of the earth's surface, power must be transmitted to the drive motor 28 through the isolating packer. In the illustrated embodiment, power is transmitted through a lower or jumper cable 40 which is electrically coupled to a connector 42. Connector 42, at its upper end, is coupled to an upper cable section 44 which extends from the connector to the earth's surface where it is coupled to drive, control and monitoring circuitry (not represented). To accommodate the passage of electrical conductors through the packer, the embodiment illustrated in FIG. 1 includes a transition assembly 45 in which connector 42 is installed.

Various forms of transition assemblies 45 may be used for the present completion purposes. In general, however, the transition assembly permits electrical signals to be transmitted from the upper zone of the well to the lower zone where the signals are transferred through lower cable 40. In the illustrated embodiment the transition assembly provides for sealed passage of a portion of the cable assembly, either upper cable 44 or lower cable 40 through a passage formed in the packer. Thus, the pressure differential which is provided by pump 36 and packer 20 is not lost as the electrical power is transmitted to motor 28.

In the embodiment of FIG. 1, transition assembly 45 includes a lower tubing section 46 which is coupled to outlet section 38 of the submersible pump. Tubing section 46 may be secured to the outlet section by any suitable means, such as screwed connections, crimped connections, compression couplings, welded or similar permanent connections, and so forth. An upper end of tube section 46 fits about a lower portion of a connector adapter 48. Connector adapter 48, which generally takes the form of a side pocket mandrel, provides fluid passage between tubing section 46 and an intermediate tubing section 50. Moreover, connector adapter 48 includes a sidewall portion in which connector 42 is sealingly installed. Thus, fluid may be transferred from pump 36 through outlet section 38, tubing section 46 and the fluid passage within connector adapter 48 generally unimpaired and with little or no change in velocity or pressure drop due to cross-sectional flow area.

Intermediate section 50 is secured to a coupling 52. Coupling 52 is, in turn, secured to an upper tubing section 54 which fits within a first fluid passageway 56 through packer 20. Again, connections between the various tube sections, couplings, and other components of transition assembly 45 may be made through any suitable means such as via screwed or compression connections, permanent connections, or the like. In the embodiment of FIG. 1, upper cable assembly 44 passes from connector 42 through coupling 52 and upper tubing section 54 to exit through passageway 56 in packer 20. From this location, the cable assembly extends to the well head at the earth's surface.

To permit the production of gas phase components from the well, a second passageway 58 is provided in packer 20. A production conduit 60 is secured to this passageway and extends from the packer to a collection location, such as above the earth's surface. To provide enhanced production flow rates, liquid phase components are forced upwardly in the well through a region surrounding conduit 60, to exit the well at a production conduit 62. As will be appreciated by those skilled in the art, conduits 60 and 62 will typically be coupled to flow control valving, and additional downstream processing and collection equipment (not shown).

Figure 2:
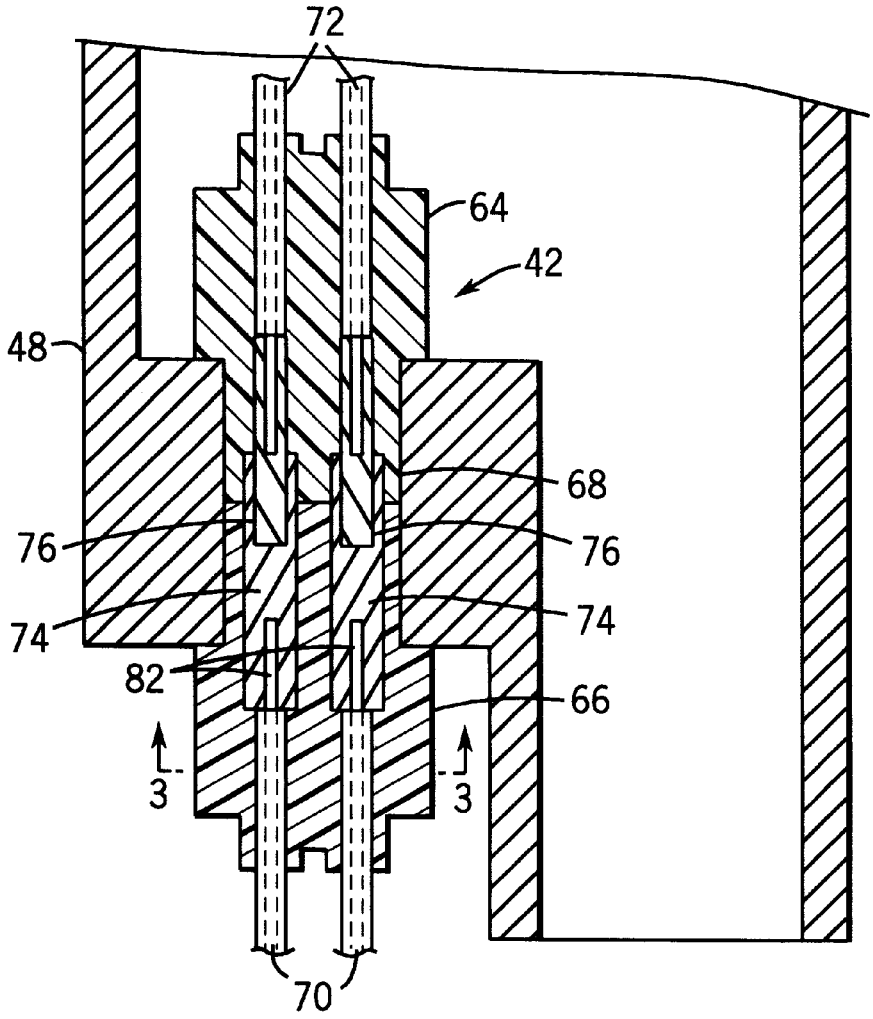
FIG. 2 is a sectional view through a field-installable connector for use in a system such as that shown in FIG. 1 to convey electrical power from the earth's surface to a submersed pumping system.
Figure 3:
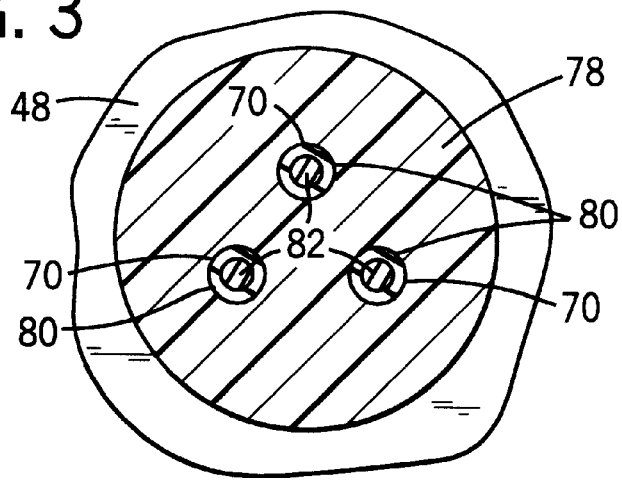
FIG. 3 is a sectional view along line 3—3 of FIG. 2 illustrating the position of the conductors within a portion of the arrangement of FIG. 2; and, FIG. 4 is an elevational view of an alternative configuration for a completion in which a cable assembly connection is made above a packer in a gas transfer conduit.

The arrangement of FIG. 1 is particularly well suited to producing both liquid and gas phase components from the well, while providing sealed transmission of electrical power and control signals through a two-passageway packer. Of course, more or other passageways and conduits may be provided, where desired. In a presently preferred embodiment, connector 42 is a field-mateable connector which can be made up at a well site, thereby further facilitating installation of the completion as well as its servicing. FIGS. 2 and 3 illustrate exemplary configurations of such a field-mateable connector coupled to conductors of the upper and lower cable assemblies.

As shown in FIG. 2, connector 42 is installed in a lateral extension of connector adapter 48. The connector includes an upper connector section 64 which mates with a lower connection section 66. In this embodiment, both connector sections extend partially through an aperture 68 formed within connector adapter 48. One or both of the connector sections is sealed within the connector adapter 48, such as via a compression fit within the adapter, or by compression rings, o-rings, or similar sealing structures. Moreover, the connector sections are securing retained within the connector adapter, such as by retaining plates, threaded engagement, or the like. It should be noted, however, that various other forms of seals and retaining structures may be incorporated in the completion for secure and sealed passage of electrical power through the connection adapter. These may include such structures as epoxy adhesives applied between one or both of the connector sections and the passageway through the connector adapter. Moreover, forms of connectors other than those shown in FIGS. 2 and 3 may be employed, such as connectors employing a central connector section installed in aperture 68 and to which both upper and lower connector plugs are mated.

In the embodiment shown in FIGS. 2 and 3, the connector is field-mateable, and includes socket and plug assemblies for providing electrical continuity through the connector sections. Lower connector section 66 thus receives insulated conductors 70 of the lower or jumper cable assembly, while upper connection section 64 receives insulated conductors 72 of the upper cable assembly. Within the connector sections, conductive structures are designed to provide electrical continuity between these insulated conductors. Thus, socket members 74 are provided in lower connector section 66, and mating plug assemblies 76 are provided, extending from upper connector section 64. Within both the upper and lower connector sections, the insulated cable conductors extend through an insulative body 78 shown in the case of the lower connector section illustrated in FIG. 3. In the illustrated embodiment each insulated conductor 70 of the lower cable assembly includes a further insulative jacket 80 and one or more conductive cables or wires 82. Upper cable assembly conductors 72 have a generally similar structure. Prior to installation of the completion, the insulative jackets of the individual conductors are stripped and the conductors are electrically secured to respective socket assemblies 74 and plug members 76, as shown in FIG. 2. Thereafter, electrical connection may be completed simply by mating the connector sections, and securing the connector sections sealingly within the connector adapter.

As will be appreciated by those skilled in the art the foregoing structure may be employed with various forms of cable assemblies. By way of example, in the illustrated embodiment, the upper and lower cable assemblies each include three electrical conductors. These are arranged in a generally circular or triangular arrangement. As will also be appreciated by those skilled in the art, cable assemblies employed in well environments may generally include one or more chemical or fluid resistant insulated layers, as well as an exterior armor or shielding layer. Moreover, the conductors of such cables may be laid in line, providing a generally flat resulting cable assembly. Additionally, one or more control lines may be provided in the upper and lower cable assemblies, with appropriate connections being made within the connector 42. Such control lines may include electrical data transmission lines, instrumentation and monitoring lines, fluid transfer tubings, and so forth.

Figure 4:
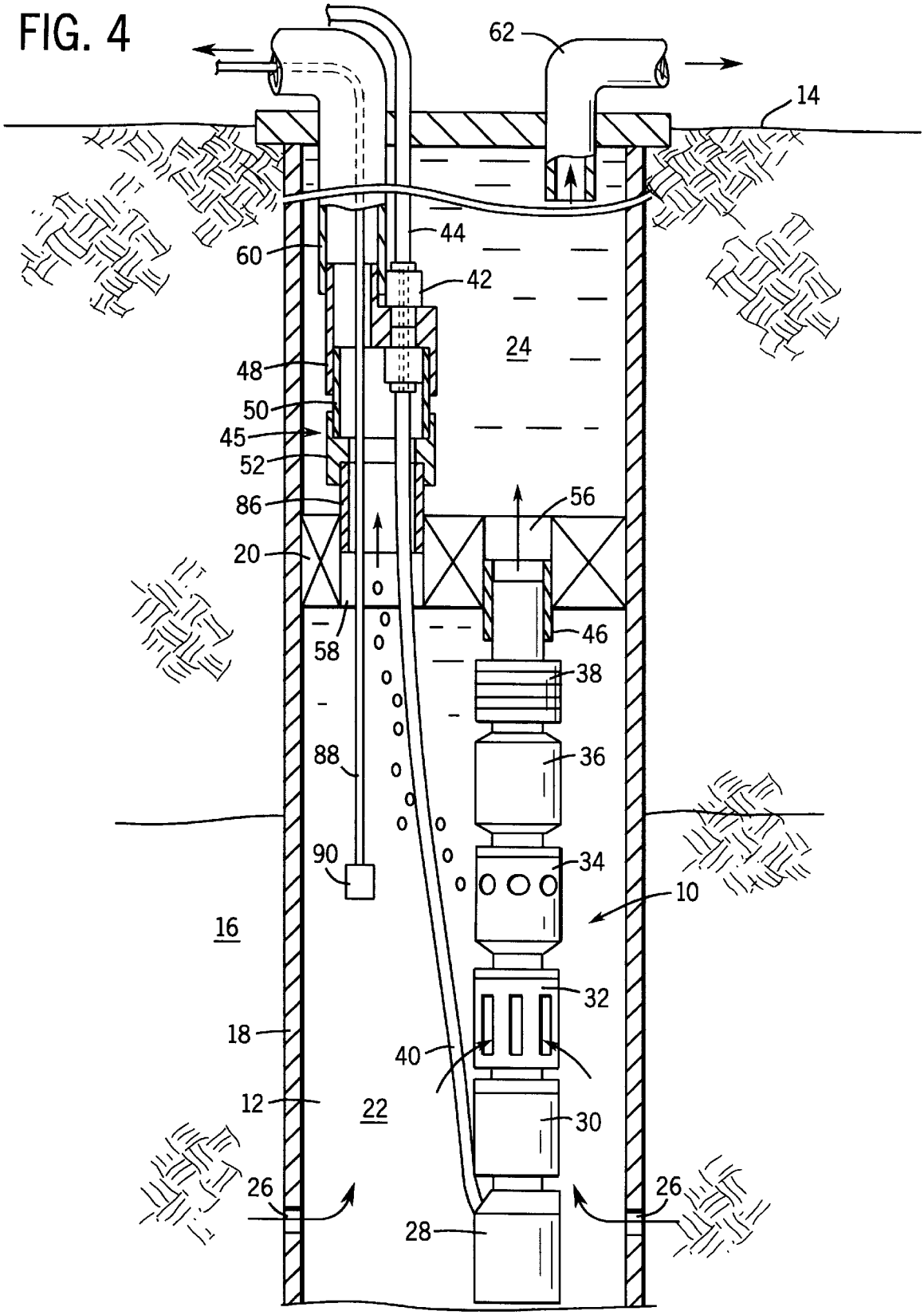

As noted above, the present completion technique may be adapted for installation of a connector above the packer, rather than below the packer as described above. FIG. 4 illustrates this type of arrangement. In the structure of FIG. 4, the components of the completion pumping system may be substantially identical to those described above with reference to FIG. 1. However, in this embodiment, tubing section 46 exiting from outlet section 38 of the pumping system is coupled directly to the first passage 56 within the packer. The second passage 58 through the packer is coupled to a transition tubing section 86. This transition section 86 is, in turn, secured to a coupling 52 which may be substantially identical to that described above with reference to FIG. 1. Coupling 52 is secured to a connector adapter 48 through the intermediary of a tubing section 50. Connector adapter 48 serves to house connector 42. In this embodiment, lower or jumper cable assembly 40 extends from motor 28 through the second passageway 58 in the packer, and upwardly to connector 42. Connector adapter 48 may be substantially identical to that described above with respect to FIGS. 1 and 2. Connector 42, which may also be identical to the structure described above, is secured in the connector adapter 48 and provides electrical continuity between the conductors of lower cable assembly 40 and upper cable assembly 44.

As noted above, the foregoing structures facilitate the production of both liquid and gas phase components of wellbore fluids, while providing for sealed electrical connection of conductors through a packer having multiple flow paths. It should be noted that the structure permits enhanced production from the well by employing an annular region about conduit 60 for the production of liquid phase components. Moreover, the routing of a portion of the motor power cable through an aperture in the packer permit the use of a two-passage packer, thereby allowing packers to be employed which have larger flow bores, enhancing production of wellbore fluids, particularly of liquid phase components. As will be appreciated by those skilled in the art, where desired, liners and similar isolation structures may be provided within the well casing to further isolate liquid phase components from the well casing. Similarly, where desired, conduit 62 shown in FIG. 1 may be extended from the earth's surface completely to passageway 56 in packer 20, thereby providing a conduit within the well casing for the production of liquid phase components.

The foregoing structure also facilitates the deployment of certain well control or monitoring equipment in the final completion. For example, as illustrated in FIG. 1, a chemical injection line 84 may be extended through conduit 60 and passageway 58 into lower region 22 of the well. Such injection lines may be used for introducing corrosion inhibitors, viscosity altering chemicals, and the like, into the wellbore fluids. Similarly, as illustrated in FIG. 4, conductors or conductor assemblies 88 may be introduced through conduit 60, such as for positioning instrument packages or sensors 90 within the wellbore. Such sensors may be employed for detecting well parameters, such as pressures, temperatures, and so forth.

What is claimed is:

1. A system for producing fluids from a well, the system comprising:

a packer separating the well into upper and lower zones, the packer including first and second passageways for transferring fluids from the lower zone;

a submersible pumping system positioned in the lower zone, the pumping system including an electric motor coupled to a pump, the pump having a discharge in fluid communication with the upper zone through the packer;

a flow through adapter having an inlet, an outlet and an internal flow path in fluid communication with the packer; and an electrical connector disposed in the adapter for transmitting electrical power from the upper zone through the internal flow path to the electric motor.

2. The system of claim 1, wherein the adapter is disposed in the upper zone.

3. The system of claim 2, wherein the internal flow path is fluid coupled to the second passageway of the packer.

4. The system of claim 1, wherein the adapter is disposed in the lower zone.

5. The system of claim 1, wherein the internal flow path is fluid coupled to the first passageway of the packer.

6. The system of claim 1, further comprising a conduit extending from the packer to the earth's surface for producing gas from the lower zone.

7. The system of claim 6, wherein the pumping system includes a liquid/gas separator for separating liquid and gas phases of fluids in the lower zone.

8. The system of claim 6, wherein the conduit defines an annular area between the conduit and an inner surface of the well, and a cable assembly coupled to the connector extends through the annular area.

9. The system of claim 1, wherein the electrical connector comprises a field mateable electrical connector sealed in an opening extending from the internal flow path to an external surface of the adapter.

10. A well completion system for producing fluids from a well, the system comprising:

a packer including first and second passageways, the packer separating the well into upper and lower zones;

a submersible pumping system disposed in the lower zone and including an electric motor drivingly coupled to a pump, the pump having a discharge coupled to the first passageway of the packer;

a flow though adapter coupled between the pump discharge and the first passageway of the packer for transferring fluid from the pump to the upper zone; and an electrical supply assembly extending from the earth's surface, through the first passageway of the packer and through the adapter to transmit electrical power to the electric motor.

11. The system of claim 10, wherein the electrical supply assembly includes a first cable extending from the adapter to the earth's surface, a connector disposed in a wall of the adapter and coupled to the first cable, and a second cable coupled to the connector and extending from the adapter to the electric motor.

12. The system of claim 10, further comprising a conduit disposed in the upper zone and fluid coupled to the second passageway.

13. The system of claim 12, wherein the pumping system includes a liquid/gas separator for separating liquid and gas phases of fluids in the lower zone, and wherein gas from the separator flows through the conduit.

14. The system of claim 10, wherein the adapter includes a side pocket mandrel having a inlet and an outlet, the outlet having a flow area larger than the inlet.

15. The system of claim 14, wherein the adapter further includes a first tube coupled to the outlet, a reducing coupling coupled to the first tube, and a second tube of smaller flow area than the first tube and coupled between the reducing coupling and the packer.

16. A well completion system for producing fluids from a well, the system comprising:

a packer including first and second passageways, the packer separating the well into upper and lower zones;

a submersible pumping system disposed in the lower zone and including an electric motor drivingly coupled to a pump, the pump having a discharge coupled to the first passageway of the packer;

a conduit disposed in the upper zone and in fluid communication with the second passageway of the packer;

a flow though adapter disposed in the upper zone and coupled between the conduit and the second passageway of the packer; and an electrical supply assembly extending from the earth's surface, through the adapter and the second passageway of the packer to transmit electrical power to the electric motor.

17. The system of claim 16, wherein the electrical supply assembly includes a first cable extending from the adapter to the earth's surface, a connector disposed in a wall of the adapter and coupled to the first cable, and a second cable coupled to the connector and extending from the adapter to the electric motor.

18. The system of claim 16, wherein the pumping system includes a liquid/gas separator for separating liquid and gas phases of fluids in the lower zone, and wherein gas from the separator flows through the conduit.

19. The system of claim 18, wherein the conduit extends to the earth's surface.

20. The system of claim 16, wherein the adapter includes a side pocket mandrel having a inlet and an outlet, the inlet having a flow area larger than the outlet.

21. The system of claim 20, wherein the adapter further includes a first tube coupled to the inlet, a reducing coupling coupled to the first tube, and a second tube of smaller flow area than the first tube and coupled between the reducing coupling and the packer.

22. The system of claim 16, further comprising a sensor disposed in the lower zone through the second passageway of the packer.

23. A method for completing a production well, the method comprising the steps of:

separating the well into upper and lower zones via a packer having at least first and second passageways;

disposing a submersible pumping system in the lower zone, the pumping system including an electric motor drivingly coupled to a pump;

supplying electrical power to the motor via a flow through adapter and an electrical connector sealingly disposed in the adapter, an upper cable assembly coupled between the earth's surface and the connector, and a lower-cable assembly coupled between the connector and the electric motor; and transferring a first fluid from the lower zone through the first passageway via the pump and transferring a second fluid from the lower zone through the second passageway.

24. The method of claim 23, wherein the adapter is disposed in the lower zone and coupled between an outlet of the pump and the fist fluid passageway of the packer.

25. The method of claim 23, wherein the adapter is disposed in the upper zone and coupled between a conduit disposed in the upper zone and the second fluid passageway of the packer.

26. The method of claim 23, wherein the pumping system further comprises a liquid/gas separator and wherein the step of transferring includes transferring gaseous phase fluid components through the second fluid passageway.

27. The method of claim 26, wherein the second fluid passageway is coupled to a conduit extending to the earth's surface, and wherein the gaseous phase fluid components are transferred to the earth's surface.

* * * * *